United States Patent [19]

Grosshauser

[11] Patent Number: 4,467,719

[45] Date of Patent: Aug. 28, 1984

[54] WEB-FED OFFSET ROTARY PRINTING MACHINE

[75] Inventor: Heinrich K. Grosshauser, Würzburg, Fed. Rep. of Germany

[73] Assignee: Koenig & Bauer Aktiengesellschaft, Wurzburg, Fed. Rep. of Germany

[21] Appl. No.: 404,002

[22] Filed: Aug. 2, 1982

[30] Foreign Application Priority Data

Aug. 6, 1981 [DE] Fed. Rep. of Germany ..... 3131170

[51] Int. Cl.[3] ..... B41F 5/06; B41F 13/02

[52] U.S. Cl. ..... 101/221; 101/180; 101/DIG. 21

[58] Field of Search ..... 101/138, 139, 180, DIG. 21, 101/181, DIG. 10, 216, 217, 218, 219, 220, 221, 415.1, 348, 222

[56] References Cited

U.S. PATENT DOCUMENTS

| | | | |
|---|---|---|---|
| 1,284,867 | 11/1918 | Bradley et al. | 101/348 |
| 1,395,318 | 11/1921 | Warner | 101/348 |
| 1,814,806 | 7/1931 | Hormel | 101/218 X |
| 2,649,734 | 8/1953 | Ras | 101/138 |
| 4,207,815 | 6/1980 | Watanabe | 101/181 X |
| 4,231,559 | 11/1980 | Wescherfelder et al. | 493/426 |

FOREIGN PATENT DOCUMENTS

| | | | |
|---|---|---|---|
| 2165185 | 11/1972 | Fed. Rep. of Germany . | |
| 2753284 | 5/1979 | Fed. Rep. of Germany . | |
| 2924572 | 1/1981 | Fed. Rep. of Germany | 101/180 |
| 2009042 | 6/1979 | United Kingdom . | |

OTHER PUBLICATIONS

Druckmaschinen Nachrichten 63, A publication of Maschinenfabrik Augsburg-Nurnberg Aktiengesellschaft.

*Primary Examiner*—Edgar S. Burr
*Assistant Examiner*—Charles A. Pearson
*Attorney, Agent, or Firm*—Jones, Tullar & Cooper

[57] ABSTRACT

A web-fed offset rotary printing machine is disclosed. First and second satellite printing units are utilized to perform multiple color recto and verso printing. The cylinder diameters and bearer ring diameters of the first satellite unit are capable of being varied with respect to those of the second unit to accurately control paper web tension and hence to accomplish a color registry which is highly accurate. Calibrated underlay sheets are used to adjust the cylinder diameters and thin, hard, flexible bands are secured on the outer peripheries of inner rings to vary the bearer ring diameters.

3 Claims, 3 Drawing Figures

WEB-FED OFFSET ROTARY PRINTING MACHINE

FIELD OF THE INVENTION

The present invention is directed generally to a web-fed offset rotary printing machine. More particularly, the present invention is directed to a web-fed offset rotary printing machine including two spaced satellite printing units. Most specifically, the present invention is directed to a web-fed offset rotary printing machine having satellite printing units provided with means to maintain precise color registry. Each of the satellite printing units may have a plurality of blanket and plate cylinders whereby recto and verso color printing is accomplished. To maintain precise color registry, the diameters of one satellite printing unit's cylinders are variable with respect to the diameters of the second unit's cylinders. The diameters of the bearer rings associated with each of the cylinders in the first unit are also capable of being varied by a corresponding amount.

DESCRIPTION OF THE PRIOR ART

The use of satellite printing units is known generally in the art as may be seen, for example, in German Published Application No. 2,165,185. Such satellite printing units are often used to perform recto and verso printing of multiple colors on moving webs. In such printing, it is desirable to maintain color registry with a high degree of precision. This is often difficult to accomplish as the web tension can vary between the two satellite units since the web can stretch and elongate. This amount of web elongation is a function of web speed and of other variables such as the type of paper being printed on. While various means are known in the prior art which attempt to obtain precise color registry in recto and verso printing in satellite units, precise web registry control remains an ongoing concern.

SUMMARY OF THE INVENTION

It is an object of the present invention to provide a web-fed offset rotary printing machine.

Another object of the present invention is to provide a web-fed offset rotary printing machine having satellite printing units.

A further object of the present invention is to provide a printing machine for recto and verso color printing.

Yet another object of the present invention is to provide a multiple satellite printing unit having means to obtain precise color registry.

Yet a further object of the present invention is to provide a web-fed offset rotary printing machine having two satellite printing units which provides precise color registry in recto and verso printing.

As will be set forth in greater detail in the description of the preferred embodiment, the web-fed offset rotary printing machine in accordance with the present invention includes first and second satellite printing units which accomplish recto and verso color printing on the web. Each satellite unit includes a counter pressure cylinder, a plurality of blanket cylinders, and cooperating plate cylinders. These cylinders are provided with bearer rings at their outer ends with the bearer rings of cooperating units contacting each other to maintain proper spacing of the cylinders. In printing units of this type precise color registry can be accomplished by varying the diameters of the cylinders in the first unit with respect to the cylinders in the second unit. The first unit's cylinders are of a slightly lesser diameter than the second unit's by 0.01% to 0.4% with this variation being based on factors such as the type of paper being printed on.

In the present invention, the cylinder diameters are varied by the proper selection of calibrated underlay sheets which are placed under the blankets and plates of the cylinders. These cylinders also utilize bearer rings and their sizes must also be varied in a manner similar to that of the cylinders. In accordance with the present invention, this is accomplished through the use of bearer rings such as are disclosed herein and in my co-pending patent application Ser. No. 403,992 entitled "Bearer Ring For Use In A Rotary Printing Unit" filed Aug. 2, 1982 and now abandoned. The bearer rings include inner rings secured on drive journals of the cylinders and outer thin, flexible hard rings or bands attached to the outer periphery of the inner rings. These rings or bands are quickly and easily removed and replaced with bands of a different thickness when the calibrated underlay sheets are changed. Thus the diameters of the cylinders and their associated bearer rings are able to be changed in response to differing tension adjustment requirements presented by various paper web compositions and the like.

BRIEF DESCRIPTION OF THE DRAWINGS

While the novel features of the web-fed offset rotary printing machine in accordance with the present invention are set forth with particularity in the appended claims, a full and complete understanding of the invention may be had by referring to the description of the preferred embodiment as set forth hereinafter and as may be seen in the accompanying drawings in which:

DESCRIPTION OF THE PREFERRED EMBODIMENT

Figure 1:
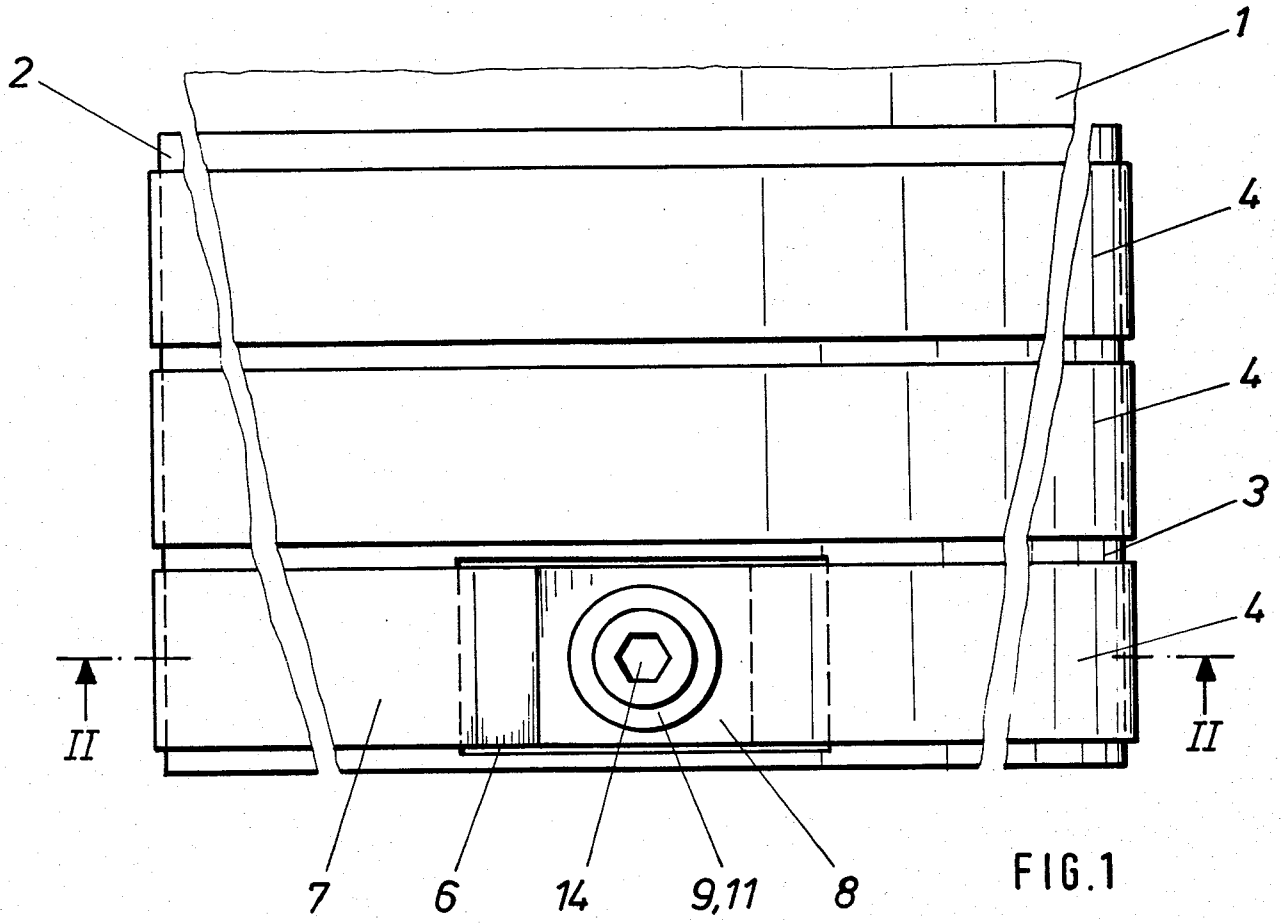
FIG. 1 is a top plan view of a bearer ring in accordance with the present invention.

Turning initially to FIG. 1 there may be seen a bearer ring for use in a rotary printing machine in accordance with the present invention. An inner steel ring 2 of, for example, 70 mm width is secured on the drive journal (not shown) of a forme or plate cylinder shown generally at 1. Steel ring 2 is rigidly secured to the drive journal by any conventional means as is well known in the art. While the description of the bearer ring arrangement will hereinafter be limited to one end of one forme cylinder 1, it will be understood that such bearer rings are utilized with cooperating cylinder groups and are typically positioned on both ends of each such cylinder.

As may seen in FIG. 1, three hardened steel tapes or bands 4, having equal thickness, are placed side by side on an outer peripheral surface 3 of inner ring 2. Depending on their widths, the steel tapes or bands 4 can contact each other or can be spaced at equal distances from each other. These tapes or bands 4 are calibrated tapes which have uniform thicknesses over their entire lengths and which also have uniform thicknesses with respect to each other.

Figure 2:
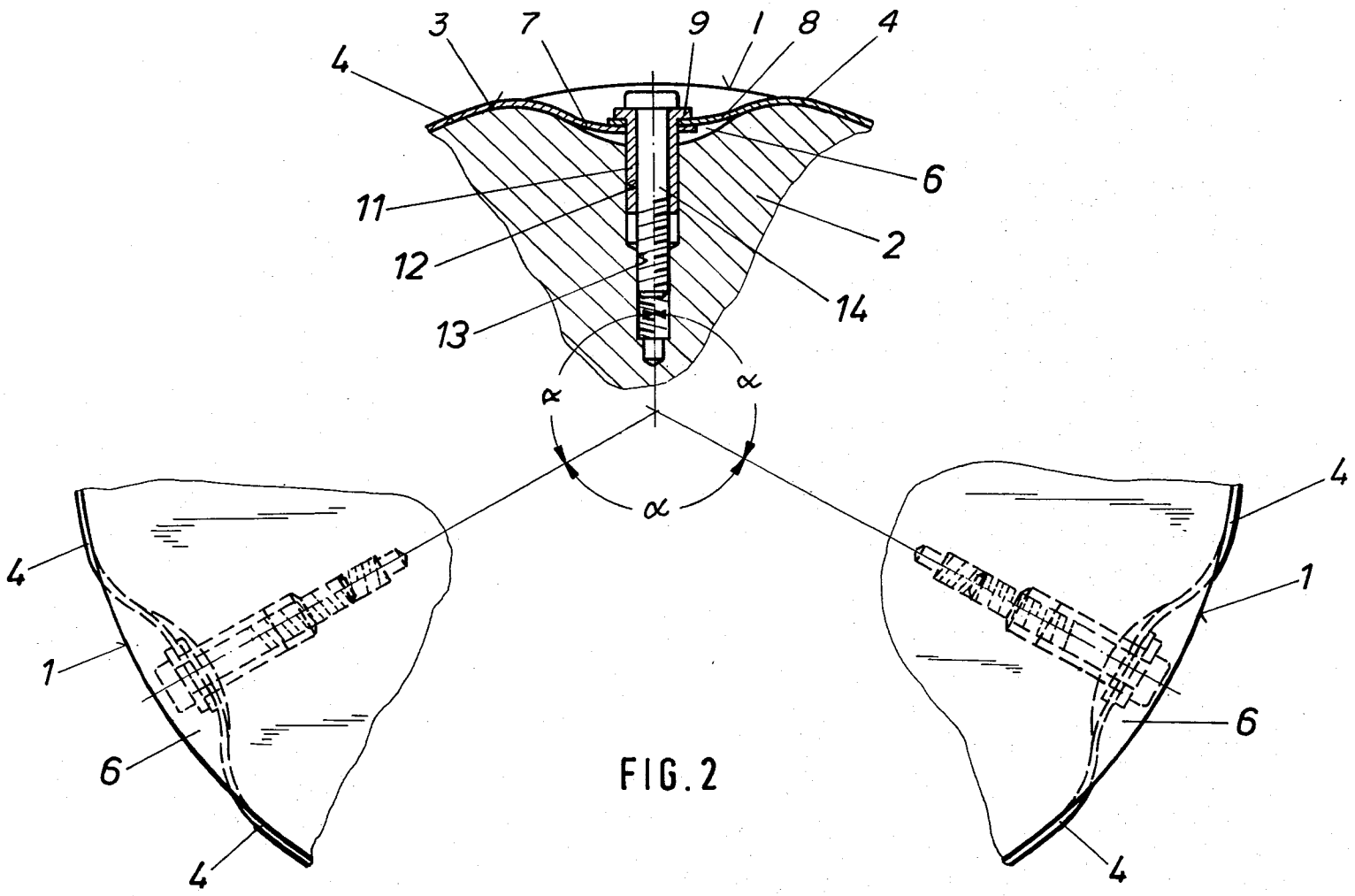
FIG. 2 is a partial sectional view of the bearer ring taken along line II—II of FIG. 1.

Referring now to FIG. 2, a recess 6 is provided in the surface of inner ring 2, this recess underlying a steel band or tape 4 coordinated with it. It will thus be understood that each tape 4 on inner ring 2 is associated with a recess 6. The side faces of each recess 6 which extend in the circumferential direction of the tape or band 4 are rounded off so that the ends 7 and 8 of each band 4 can be easily drawn downwardly into recess 6 as the tape 4 is secured about the periphery 3 of inner ring 2.

Securement of each steel band or tape 4 onto the periphery 3 of inner ring 2 is accomplished by providing an aperture in each end 7 and 8 of tape 4. A cylindrical bushing 11 having an enlarged or flanged head portion 9 is inserted through the apertures in the ends 7 and 8 of tape 4 and down into a smooth-sided bore 12 which is formed in the bottom of recess 6. Bore 12 is provided with threads 13 at its lower portion beyond the depth to which cylindrical bushing 11 extends. An internal hexagon headed screw 14 is passed through the interior of cylindrical bushing 11 and is screwed into the threaded hole 13. As screw 14 is tightened, the ends 7 and 8 of band 4 are drawn down into recess 6 to thereby tighten the band 4 about the periphery 3 of inner ring 2. It will, of course, be understood that recess 6 has sufficient depth so that the head of screw 14 does not protrude above the surface of band 4.

Since the bearer rings 4 are cooperating with other similar bearer rings placed on a cooperating cylinder, and further since it is imperative that these bearer rings run smoothly, the bearer rings 4 for the forme cylinder 1 and the cooperating bearer rings for a cooperating cylinder such as a blanket cylinder (not shown) are secured to inner ring 2 in a staggered manner from each other by staggering the placement of recesses 6 in the peripheral surface 3 of inner ring 2. Thus in the embodiment shown in FIGS. 1 and 2, since there are bands 4, the three recesses 6 are disposed at an angle $\alpha$ of 120° to each other. This spacing prevents the bearer rings 4 of the forme cylinder 1 from "falling" into recesses in the bearer rings carried by the cooperating blanket cylinder. It will be understood that the angle $\alpha$ at which the recesses will be spaced from each other will be dependent on the number of tapes or bands 4 being used.

Figure 3:
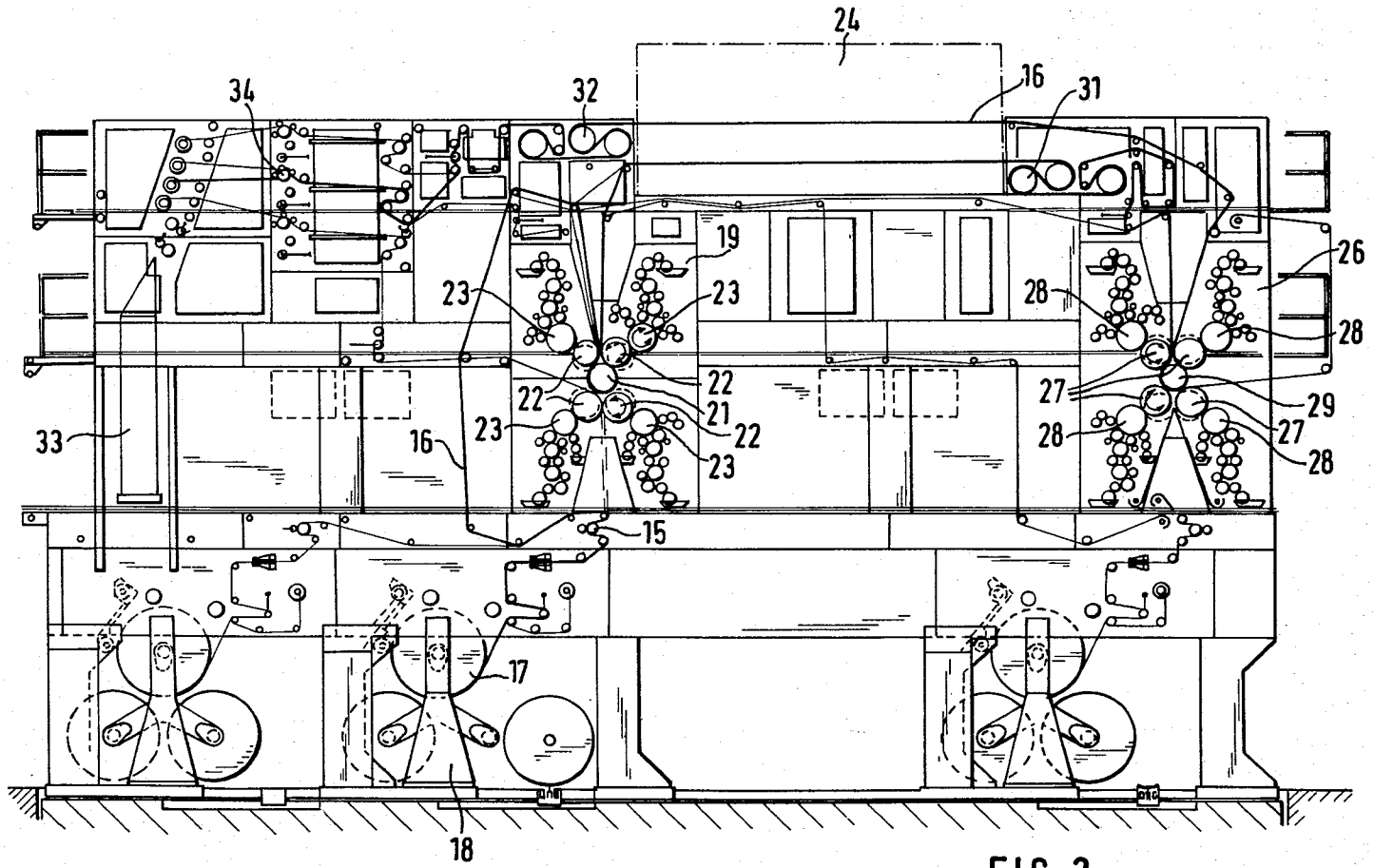
FIG. 3 is a schematic side elevation view of a web-fed rotary printing machine in accordance with the present invention and having two satellite printing units.

Referring now to FIG. 3, there may be seen a web-fed offset rotary printing machine in accordance with the present invention in which the bearer rings described hereinabove may be utilized. A paper web 16 is unrolled from a paper reel 17 which is supported on a reel star in a known manner. Web 16 is transferred over a plurality of paper guide rollers into a first infeed device 15 in a first satellite printing unit 19. This satellite printing unit 19 includes a counter pressure or impression cylinder 21, four blanket cylinders 22 spaced about and contacting counter pressure cylinder 21, and four forme cylinders 23. Each of these forme cylinders 23 cooperates with one of the blanket cylinders 22. Each of the cylinders 21, 22, and 23 are preferably of equal diameter and carry bearer rings at their ends. The counter pressure cylinder 21 is almost completely encircled by the paper web 16 during printing. Since there are four blanket cylinders and four forme cylinders 23, it is possible to print four separate colors on one side of web 16 as it passes through first satellite printing unit.

After web 16 has its printing done by satellite printing unit 19, it passes through a suitable dryer 24 and then through chilled roll group 31 to a second satellite printing unit 26 for printing in, for example, four different colors. Second satellite printing unit 26 is essentially the same as first unit 19 and has a counter pressure cylinder 29, four blanket cylinders 27, and four forme cylinders 28 each of which cooperates with a blanket cylinder 27. These cylinders 27, 28, and 29 are of equal diameters and are also capable of carrying bearer rings of equal size. Paper web 16 substantially encircles counter pressure cylinder 29 during its printing.

Paper web 16, which has now been printed by the two satellite printing units, is fed out of the second satellite printing unit 26, back through dryer 24, through a second chilled roll group 32 and to a conventional folder 33 where it is processed to form signatures.

In order to obtain perfect color registry in verso printing in satellite unit 26, it is necessary to keep the web 16 under tension between first satellite unit 19 and second satellite unit 26. This tension can differ depending on the type of paper being printed upon. In order to maintain this paper web tension at a desired level, the cylinders and bearer rings of the first satellite printing unit 19 are adjusted to have a diameter less than the diameters of the cylinders and bearer rings of the second unit 26. The amount of this variance in diameter will depend on the type of paper being printed on.

In accordance with the present invention, the diameter of the cylinders of the first unit 19 may be 0.01% to 0.4% less than those of the second satellite unit 26. The satellite printing unit which preceeds the folder 33; i.e. the second satellite printing unit 26 is the unit of reference or the "zero" unit. This difference in diameters allows the maintenance of a preselected paper web tension whereby accurate color registry in four color verso printing is accomplished.

The diameters of the cylinders 21, 22, and 23 in the first satellite printing unit 19 are adjusted by placing calibrated underlay sheets under the rubber blanket of the counter pressure cylinder 21, under the rubber blanket of the blanket cylinders 22 and under the offset printing plates of the forme cylinders 23. The diameters of the inner steel cores of the cylinders 21, 22, and 23 of the first satellite unit 19 may be smaller than the diameters of the cylinders of the second satellite unit 26. Thus by proper selection of a calibrated underlay sheet, the diameters of first satellite unit 19 can be properly sized.

Concurrently with an adjustment in the cylinder diameters, a change must be made in the diameters of the bearer rings carried by the cylinders. Although it is possible to replace conventional bearer rings with other bearer rings of a different diameter, in accordance with the present invention, the bearer ring diameters are varied by the use of bands or tapes 4 of the appropriate thickness which are secured to inner ring 2 in a manner as has been previously discussed.

It will be understood that the paper web tension to the first satellite unit 19 is controlled by the infeed device 15 in a manner known in the art. The paper web tension between the second satellite unit 26 and folder 33 is maintained by a feed roll 34. It will further be understood that the blanket cylinders 22 and 27 and the forme cylinders 23 and 28 are supported in adjustable eccentric bearings bushings which are secured to the side frames of the unit and that the driving gears for the cylinders 21, 22, and 23 of the first satellite printing unit 19 are provided with adjustable backlash gears in a known manner thereby allowing the cylinder diameters to be adjusted.

The web-fed offset rotary printing unit in accordance with the present invention facilitates accurate control of paper web tension between two satellite printing units which are placed one after the other to thereby provide accurate color registry. By proper selection and accurate control of cylinder and bearer ring diameters, the web tension and hence color registry can be carefully controlled for different types of paper webs being printed in two or more satellite units.

While a preferred embodiment of a web-fed offset rotary printing machine in accordance with the present invention has been fully and completely set forth hereinabove, it will be obvious to one of skill in the art that a number of changes in, for example, the number of satellite units, the number of forme and blanket cylinders in each unit, the number of colors printed and the like could be made without departing from the true spirit and scope of the invention and that accordingly, the invention is to be limited only by the following claims.

I Claim:

1. A web-fed rotary printing machine comprising at least first and second spaced satellite printing units for printing on both sides of a paper web passing through said first and second satellite printing units, each of said satellite printing units having at least one counter pressure cylinder, a plurality of blanket cylinders and a plurality of forme cylinders, each of said cylinders running on bearer rings, means to maintain accurate print registry on said web by controlling web tension, said means to maintain print registry including means for varying the diameters of said cylinders and said bearer rings in said first satellite unit with respect to the diameters of said cylinders and bearer rings of said second satellite printing unit in accordance with the type of said paper web being printed on to obtain said accurate print registry by controlling the tension of said web between said first and second satellite printing units, said means for varying the diameters of said bearer rings including at least first and second sets of replaceable hardened metal bands, said bands in said first and second sets being of different thicknesses, with all of said bands in a given set having uniform thicknesses over their entire lengths and uniform thicknesses with respect to each other, said first set of said bands being secured in a staggered, adjacent manner to an inner ring portion of each of said bearer rings whereby the diameters of said bearer rings can be varied by replacement of said first set of bands by said second set of bands.

2. The web-fed rotary printing machine of claim 1 wherein, the difference in diameters of said cylinders and bearer rings of said first satellite unit and said cylinders and bearer rings of said second satellite unit is between 0.01% to 0.4%

3. The web-fed rotary printing unit of claims 1 or 2 wherein the diameters of said cylinders and bearer rings of said first satellite unit are smaller than the diameters of said cylinders and said bearer rings of said second satellite unit.

* * * * *